US005116274A

United States Patent [19]

Artwohl et al.

[11] Patent Number: 5,116,274

[45] Date of Patent: May 26, 1992

[54] REFRIGERATOR DISPLAY CABINET WITH THERMALLY INSULATED PIVOTABLE WINDOW PANE

[75] Inventors: Paul Artwohl, Flossmoor, Ill.; David Robinson, Valparaiso, Ind.

[73] Assignee: Ardco, Inc., Chicago, Ill.

[21] Appl. No.: 591,746

[22] Filed: Oct. 2, 1990

[51] Int. Cl.[5] ..... A47F 3/04

[52] U.S. Cl. ..... 312/116; 312/139; 312/319; 49/349; 49/344

[58] Field of Search ..... 312/116, 138, 139, 319; 49/340, 344, 349, 398, 507; 52/790

[56] References Cited

U.S. PATENT DOCUMENTS 3,994,109 11/1976 Pandell ..... 52/790
4,842,349 6/1989 Stenemann ..... 312/16

FOREIGN PATENT DOCUMENTS 3503340 8/1986 Fed. Rep. of Germany ..... 312/116
3828089 3/1989 Fed. Rep. of Germany ..... 312/116

*Primary Examiner*—Kenneth J. Dorner
*Assistant Examiner*—Gerald A. Anderson
*Attorney, Agent, or Firm*—Leydig, Voit & Mayer

[57] ABSTRACT

A refrigerator display cabinet having a front opening and a thermally insulated multiple-glass pane window panel mounted for pivotal movement about a horizontal axis adjacent the upper marginal end of the window panel. The window panel has an internal solid spacer bar adjacent the upper marginal end thereof which permits secure clamping of the window panel by hinge supports without crushing or other damage to the window panel. The hinge supports have a relatively streamlined configuration, which, together with the substantially frameless window panel, provide an esthetic modernistic appearance.

30 Claims, 3 Drawing Sheets

FIG. 1
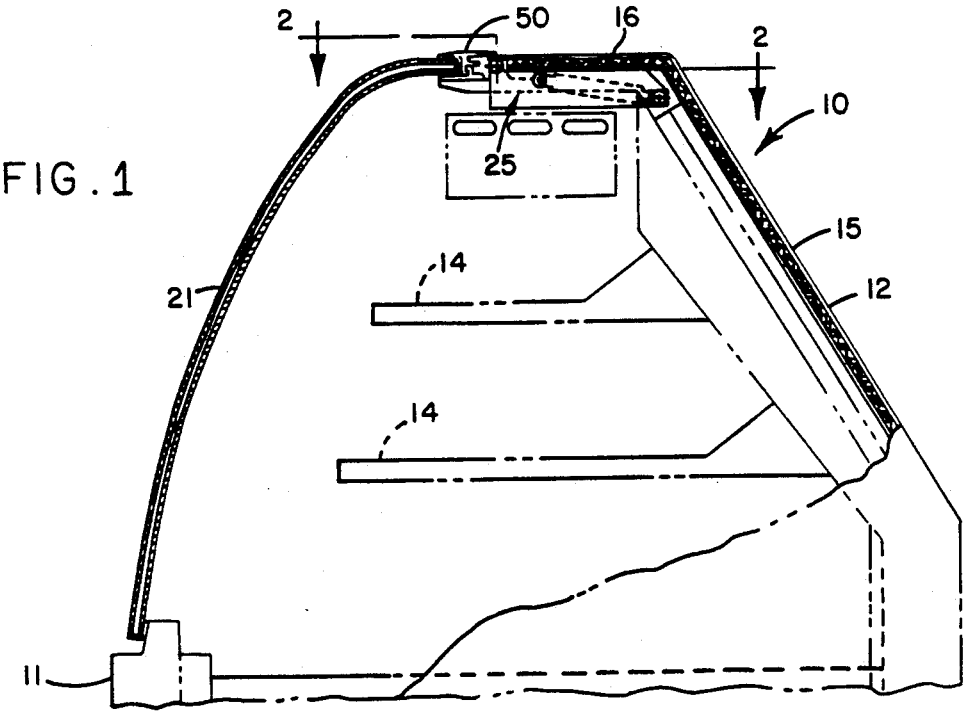
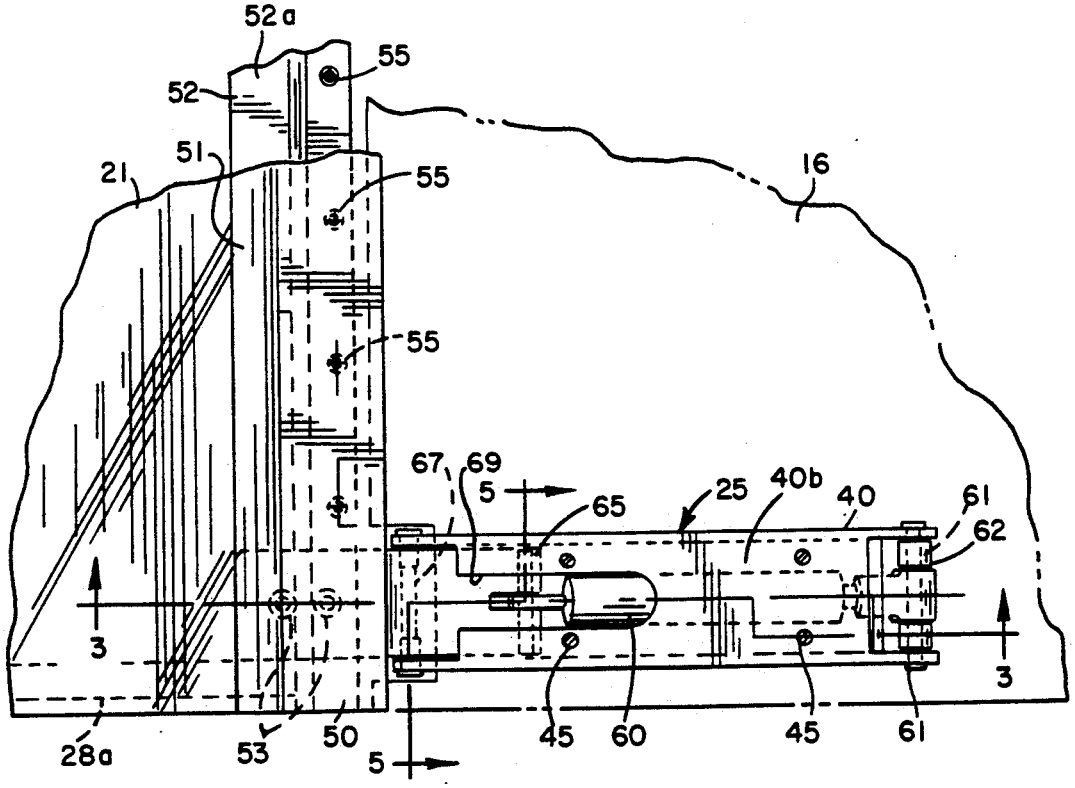
FIG. 2

REFRIGERATOR DISPLAY CABINET WITH THERMALLY INSULATED PIVOTABLE WINDOW PANE

FIELD OF THE INVENTION

The present invention relates generally to refrigerator display cabinets, and more particularly, to refrigerator display cabinets that are used in supermarkets, butcher shops and the like for cooling and displaying food products and which include a pivotable front window panel or cover that may be opened by or with the assistance of fluid controlled cylinders for permitting access to interior of the cabinet.

BACKGROUND OF THE INVENTION

Display cabinets of such type typically have an elongated hollow configuration within which the food products are contained and a window panel extending forwardly and downwardly from a top of the cabinet for enclosing the front of the cabinet while permitting viewing of refrigerated food products and the like within the cabinet by passing customers. It is known to clamp the upper peripheral edge of the window panel in hinge assemblies and to utilize fluid controlled cylinders to facilitate pivotal movement of the window panel between a lowered, closed position and an upwardly raised, open position that permits access to the interior of the cabinet from the customer side in order to facilitate refilling of the cabinet with goods and cleaning of the cabinet interior.

Because thermal efficiency and energy costs are important considerations in operating commercial refrigeration units, it is desirable that the window panel in such display cabinets comprise a thermally insulated glass unit made up of two or more glass panes that are supported in spaced apart relation with the interior between the panes appropriately sealed. Since such thermal insulated glass units are relatively heavy due to the multiple glass pane construction, it has been difficult to lift such insulated window panels about an upper peripheral, horizontal pivot axis without crushing the edge of the glass unit that is clamped in the hinge assembly or otherwise damaging the glass unit. The relatively massive hinges required for supporting the window panel also can detract from the esthetic appearance of the cabinet, particularly when the window panel is in a raised position. The use of mounting screws to enhance securement of the thermal glass unit within the clamps of the hinge assemblies also can destroy the seal to the air insulating space between the glass panes, both adversely affecting the thermal efficiency of the glass unit as well as permitting moisture and other contaminants to migrate into the insulating space between the panes which can further detract from the appearance of the panel. As a result, it usually has been the practice to utilize single glass pane window panels in such display cabinets notwithstanding their thermal inefficiency. On the other hand, when thermal efficiency considerations dictate the use of insulated glass units, it has been necessary to support the glass unit for pivotal movement about a pivot axis adjacent the bottom of the glass unit, which can restrict design alternatives for the display cabinet and impede access to the cabinet.

OBJECTS AND SUMMARY OF THE INVENTION

It is an object of the present invention to provide a commercial refrigerator display cabinet having a window panel formed of a thermally insulated glass unit that can be repeatedly raised and lowered in a commercial environment about an upper-peripheral pivot axis without damage to the glass unit.

Another object is to provide a refrigerator display cabinet as characterized above in which the thermally insulated glass unit is less susceptible to damage from lifting forces acting on the upper peripheral edge thereof.

A further object is to provide a refrigerator display cabinet of the foregoing type which employs relatively simple, streamlined hinge and clamp assemblies that permit reliable opening and closing of the glass panel without detracting from the esthetic appearance of the display cabinet when the glass panel is an open position. A related object is to provide such a refrigerator cabinet in which the window panel has a frameless modernistic appearance.

Still a further object is to provide a refrigerator display cabinet of the foregoing type which is of relatively simple construction and which lends itself to economical manufacture.

Other objects and advantages of the invention will become apparent upon reading the following detailed description and upon reference to the drawings, in which:

BRIEF DESCRIPTION OF THE DRAWINGS

FIG. 1 is a side elevational view, in partial section, of an illustrative refrigerator cabinet embodying the present invention;

FIG. 2 is an enlarged top plan view of a portion of the illustrated refrigerator cabinet showing one of the window panel clamp and hinge assemblies;

Figure 3:
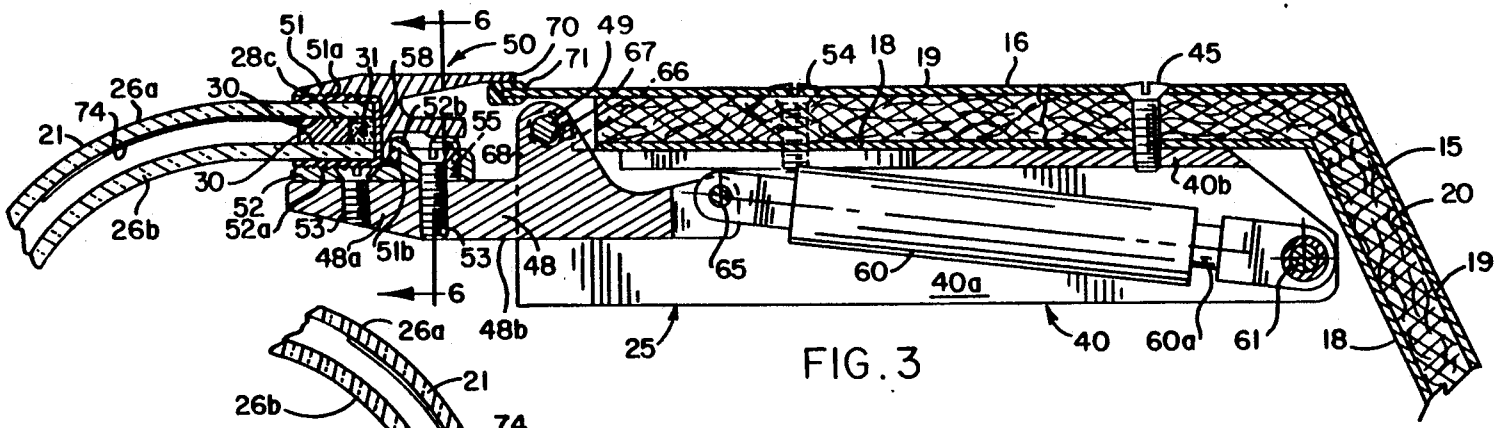
FIG. 3 is an enlarged fragmentary section taken in the plane of line 3—3 in FIG. 2 depicting the clamp and hinge assembly when the window panel is in a closed position.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DESCRIPTION OF THE PREFERRED EMBODIMENT

Referring now more particularly to FIG. 1 of the drawings, there is shown an illustrative refrigerator display cabinet 10 embodying the present invention. The cabinet 10 may be of a conventional configuration, comprising a lower section 11 for containing refrigeration means and an upper food containing section 12, in this case having a plurality of display shelves 14. The upper cabinet section 12 in this instance has a forwardly and upwardly inclined rear wall 15 on the service side of the cabinet 10 and a horizontal top wall 16 extending forwardly therefrom. The cabinet walls 15, 16 preferably have an insulated construction, in this case comprising inner and outer sheet metal plates 18, 19 with a urethane foam material 20 therebetween (FIG. 3). A window panel 21 is pivotally supported in forwardly and downwardly extending relation to the horizontal cabinet wall 16 for permitting customer viewing of products within the cabinet. To permit access to the interior of the cabinet 10, the window panel 21 is supported by a plurality of clamp and hinge assemblies 25 that permit pivotal movement of the window panel 21 between a lowered, closed position and a raised, open position.

In accordance with an important aspect of the invention, the window panel has a reinforced, thermally insulated, multiple glass pane construction that permits repeated lifting and lowering of the window panel in a commercial environment about a pivot axis adjacent the upper peripheral edge thereof without damage to the glass unit. The window panel 21 in this case comprises an insulated glass unit formed of a pair of outwardly and downwardly curved glass panes 26*a*, 26*b* disposed in parallel side-by-side relation separated by a spacer 28. The spacer 28 comprises a pair of curved spacer elements 28*b*, disposed adjacent opposite sides of the glass panes 26*a*, 26*b*, a lower horizontal spacer element 28*c*, and an upper horizontal spacer element 28*a*. The lower and side spacer elements 28*b*, 28*c* are of tubular construction and are joined together by appropriate corner keys 29 (FIG. 8), as is known in the art. The spacer elements 28*a*, 28*b*, 28*c* each are disposed in slight inwardly spaced relation to the outer peripheral edges of the glass panes 26*a*, 26*b* so as to define an outwardly opening channel area about the perimeter of the glass unit. A sealant 30, such as polyisolbutylene, is provided between the sides of the spacer elements 28*a*, 28*b*, 28*c* and the adjacent glass panes 26*a*, 26*b* for establishing a primary vapor seal. A layer of flexible sealant 31, such as polysulfide, fills the channel area about the outer periphery of the glass unit (FIG. 3). To ensure maintenance of a moisture free condition in the insulating air space between the glass panes 26*a*, 26*b*, the tubular spacer members 28*b*, 28*c* may be filled with a moisture absorbent desiccant material 32.

Figure 4:
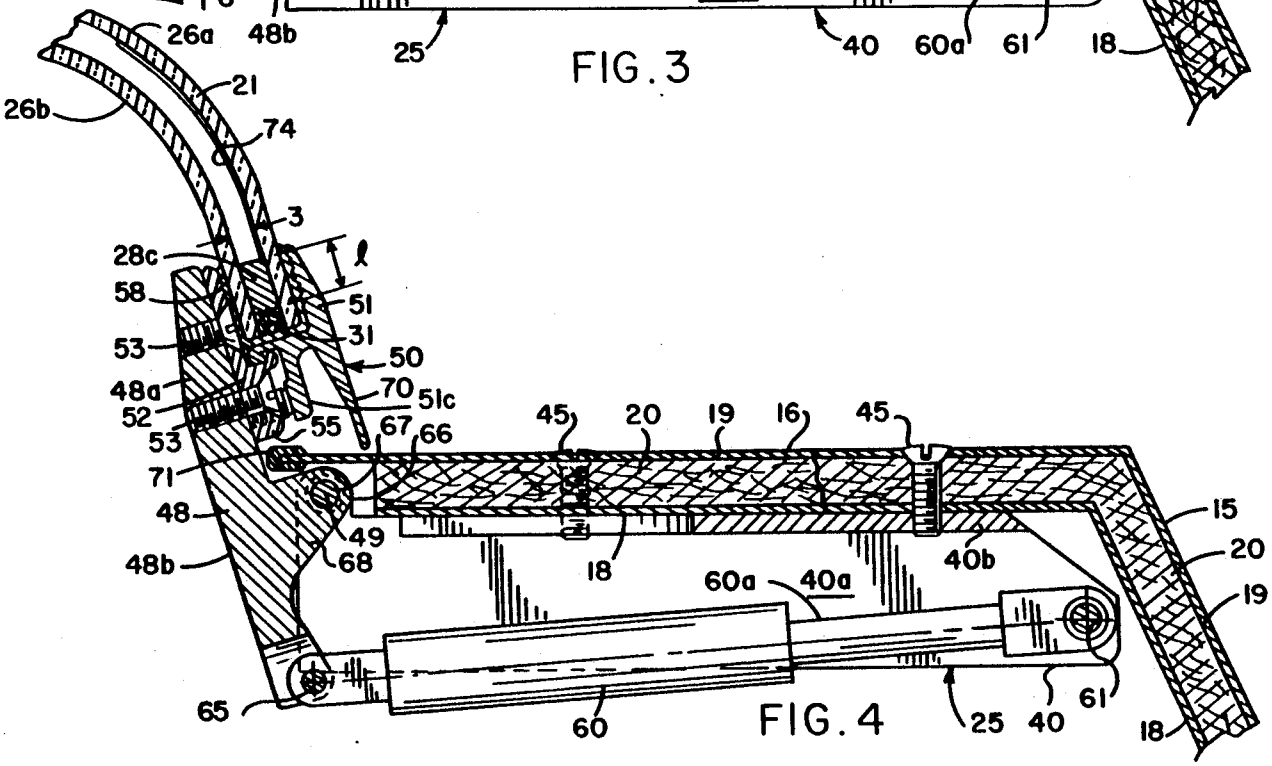
FIG. 4 is a fragmentary section, similar to FIG. 3, showing the clamp and hinge assembly with the window panel in a raised position.
Figure 5:
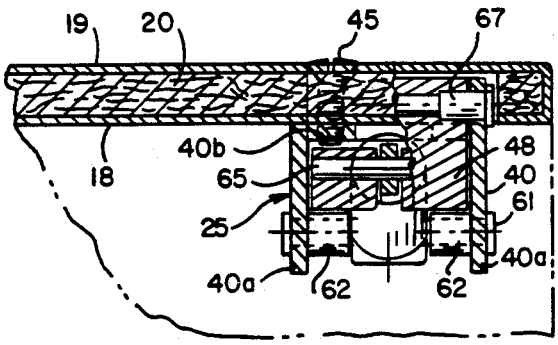
FIG. 5 is an enlarged fragmentary section taken in the plane of line 5—5 in FIG. 2.
Figure 6:
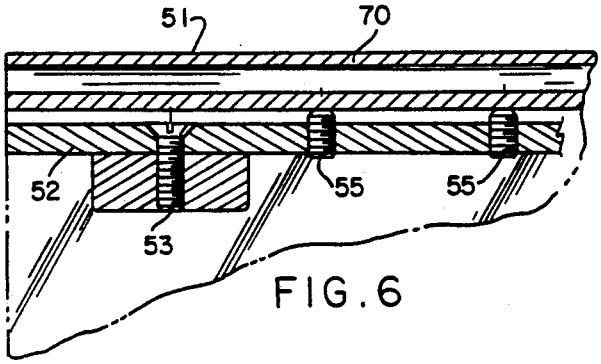
FIG. 6 is an enlarged fragmentary section taken in the plane of line 6—6 in FIG. 3.
Figure 8:
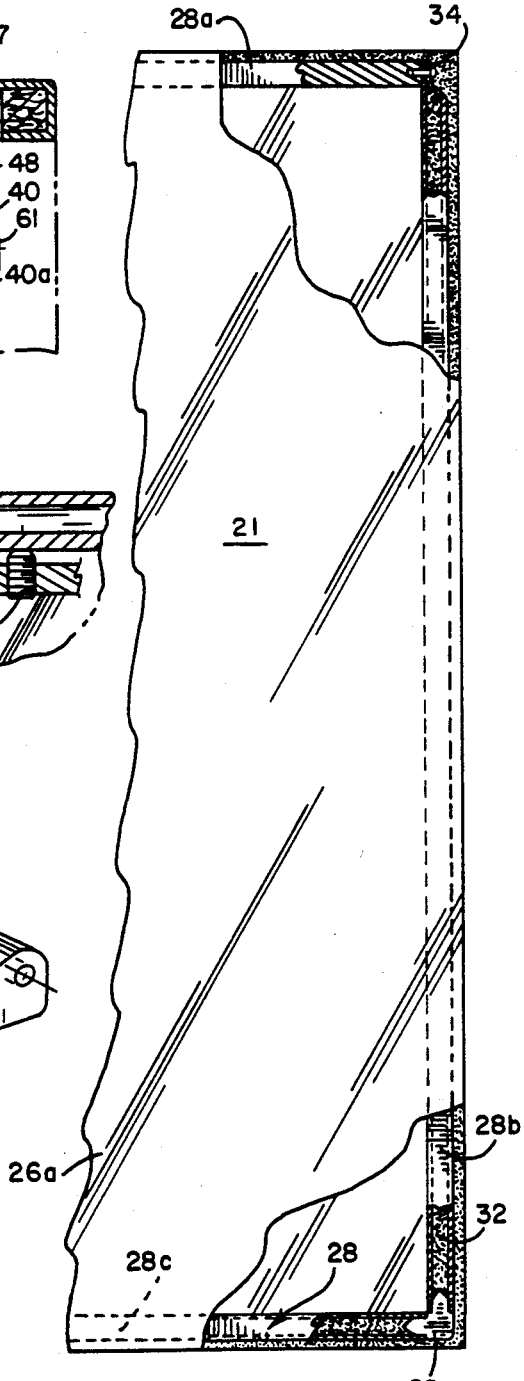
FIG. 8 is a front plan view of one side or the window panel, with portions broken away to depict the corner constructions.

In keeping with the invention, the upper spacer 28*a* of the insulated glass unit is in the form of a solid bar that permits rigid clamping and lifting of the upper peripheral or marginal end of the glass unit without crushing or damage thereto. The upper spacer bar 28*a* in this case is a solid bar of aluminum or like material of rectangular cross section and extends substantially the entire width of the window panel. For rigidly securing the solid spacer bar 28*a* to the tubular side spacer members 28*b* for enhancing the rigidity of the insulated glass unit, the side tubular spacer members 28*b* have flattened upper ends that are affixed to end faces of the solid spacer member 28*a* by pop rivets 34 or other suitable fasteners (FIG. 8). The solid spacer bar 28*a* preferably has a length "l" in the direction transverse to the pivotal axis of the window panel that is significantly greater than the width "w" which defines the spacing between the glass panes 26*a*, 26*b* so as to maximize the area over which the clamping forces are distributed. In the illustrated embodiment, the solid spacer element has a length "l" of about twice the width "w" (FIG. 4). In such arrangement, it has been found that sufficient clamping forces may be exerted on the glass unit to permit reliable lifting and lowering of the window panel without necessity for fastening screws passing through the glass unit and without crushing or other damage to the glass unit. While it has been found that the glass unit may be securely retained by the clamp and hinge assemblies 25 without the necessity for auxiliary fastening screws that pass through the glass unit, it will be appreciated that since the spacer bar 28*a* is a solid construction even if auxiliary fastening screws were employed there would be less tendency of adversely affecting the sealed condition between the glass panes 26*a*, 26*b*.

In carrying out a further aspect of the invention, the clamp and hinge assemblies 25 have a relatively simply, streamlined design for effecting reliable lifting of the window panel 21 while being substantially unnoticeable when the window panel is in either its raised or lowered positions. The clamp and hinge assemblies 25 in this instance each include a generally U-shaped mounting bracket 40 secured to the underside of the top cabinet wall 16. Each bracket 40 has a pair of depending legs 40*a* and an upper web or base 40*b* that is affixed to the underside of the top cabinet wall 16 by screws 45 that extend through the cabinet wall 16 and engage tapped apertures in the bracket web 40*b*.

The bracket 40 of each clamp and hinge assembly 25 supports a respective pivot hinge 48, in this instance in the form of a hinge plate, for relative pivotal movement about a central pivot axis 49. The pivot hinge 48 has a forwardly extending end 48*a*, as best viewed in FIG. 3, for supporting a clamp 50 adapted for engaging the upper marginal end of the window panel 21. The clamp 50 includes upper and lower clamping plates 51, 52, respectively, which extend the entire width of window panel 21. The lower clamping plate 51 is affixed to the respective pivot hinge 48 of each clamp and hinge assembly 25 by fastening screw 53, and the upper clamping plate 51 is adapted for releasable inter-fitting engagement with the lower clamping plate 52. The clamping plates 51, 52 each define a respective clamping jaw or surface 51*a*, 52*a* between which the upper end of the window panel 21 is disposed.

For permitting selected tightening of the clamping jaws 51*a*, 52*a* against the opposed sides of the window panel 21, the lower clamping plate 52 has an upwardly extending hook-shaped lip 52*b* that is engageable with a depending hook-shaped lip 51*b* of the upper clamping plate 51 for establishing a central pivot point about which the upper clamping plate 52 may be moved relative to the lower clamping plate 52. For tightening the clamping jaws 51*a*, 52*b* about the glass unit, the upper clamping plate 51 may be pivoted about the pivot point defined by the inter-engaging lips 51*b*, 52*b* by means of a plurality of clamping screws 55 each disposed in upwardly extending relation through the lower clamp plate 52. By advancing the clamping screws 55 upwardly through the lower clamping plate 52 into engagement with a rearwardly extending bearing plate 51c of the upper clamp plate 51 at a point rearwardly of the inter-engaging lips 51b, 52b, the upper clamping plate will pivot in counterclockwise direction, as viewed in FIG. 4, increasing the clamping pressure of the jaws 51a, 52a against opposed sides of the glass unit. It will be understood that by means of such clamping screw adjustment the clamping pressure of the jaws 51a, 52a against the glass unit may be selectively established.

To facilitate retention of the upper marginal end of the window panel 21 in the clamp 50 and to protect the glass unit from the metal clamping plates 51, 52, a U-shaped plastic gasket 58 encompasses the upper marginal end of the glass unit. The gasket 58 preferably has longitudinal extending ribs formed on the opposite outer sides thereof for inter-fitting engagement with longitudinal ribs formed in the jaws 51a, 52a of the clamping plates, as depicted in FIGS. 3 and 4. As indicated previously, because the upper spacer member 28a is a solid bar, significant clamping forces may be exerted on the upper peripheral end of the window panel 21 and the window panel may be lifted about its upper peripheral pivot axis without deformation of the spacer bar 28a or damage to the window panel, and the relatively long length "l" of the spacer maximizes the area over which the clamping forces are distributed.

To facilitate and control pivotal movement of the pivot hinge 48 of each clamp and hinge assembly 25 between a horizontal position in which the window panel 21 is in a closed position (FIG. 3) and a vertical position in which the window panel is in a raised open position (FIG. 4), each clamp and hinge assembly 25 includes a pneumatic cylinder 60 mounted on the underside of the respective bracket 40 between the depending legs 40a thereof. Each cylinder 60 has a piston rod 60a connected for relative pivotal movement to a pivot pin 61 mounted between lower, rearward ends of the bracket legs 40a. Spacers 62 are located on opposite sides of the pivot pin 61 for maintaining the cylinder 60 in centered position between the bracket legs 40a. Each cylinder 60 has its opposite end pivotally supported by a pivot pin 65 mounted at a rearward end of the pivot hinge 48 for the respective clamp and hinge assembly 25. When the window panel 21 is in its closed position the pivot hinge 48 and pivot pin 65 are at a slightly higher elevation than the rear pivot pin 61. It will be understood that the cylinders 60 may be of a conventional type, each having self contained fluid for facilitating lifting and lowering of the window panel in a controlled manner. Alternatively, the cylinders may be fluid actuated from an outside pneumatic or hydraulic source for exerting positive pivoting forces on the pivot hinge 48 when raising the window panel and for maintaining the window panel in a raised position.

Figure 7:
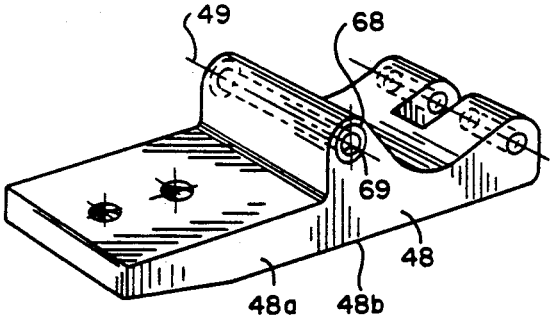
FIG. 7 is an enlarged perspective of the hinge plate of one of the clamp and hinge assemblies.

In keeping with the invention, the pivot hinge 48 of each clamp and hinge assembly 25 has an elevated pivot point and a substantially flat underside face 48b that is disposed horizontally at a level between the depending bracket legs 40a when the window panel 21 is in a closed position and which is disposed in a substantially vertical or inclined plane when the window panel is in a raised position with the flat face 48b forwardly oriented for obstruction viewing of clamp 50 and cylinder 60 and without portions of the pivot hinge 48 extending outwardly in an unsightly manner. To this end, each pivot hinge 48 has a pivot axis 49 defined by pivot pin 67 supported between upstanding ears 66 of the bracket 40 at an elevation above the bracket web 40b. To facilitate mounting of the pivot hinge 48 with such elevated pivot axis, the top side of the pivot hinge 48 has a raised mounting hub 68 formed with an appropriate pivot pin-receiving aperture 69 (FIG. 7). To permit mounting of the bracket 40 on the underside of the cabinet wall 16, the lower wall plate 18 and the insulating foam 20 are cut away to receive the hub 68, pivot pin 65 and bracket ears 66. The top plate 19 of the cabinet wall 16 overlies and covers the hinge plate pivot mounting from view. To enable free pivotal movement of the pivot hinge 48 about the pivot pin 49, the bracket web 40b in this instance is formed with a rearwardly opening clearance slot 69 (FIG. 2).

For providing a streamlined outward appearance to the clamp and hinge assembly 25 when the window panel 21 is in a closed position and to prevent communication of ambient air between the hinge assembly 25 and the cabinet walls, the upper hinge plate 51 has a rearward flange 70 extending in partially overlapping relation to the top cabinet wall 16. A U-shaped resilient sealing member 71 is mounted on the forwardly extending upper cabinet wall plate 19, which is adapted for sealing engagement with the hinge plate flange 70 when the window panel 21 is in its closed position. It will be understood that an appropriate sealing gasket also may be provided on the cabinet about the periphery of the front cabinet opening for engagement by the sides and lower peripheral end of the window panel when closed.

In order to further prevent viewing of the clamp and hinge assembly 25 within the cabinet when the window panel 21 is in a closed position, a silk screen masking 74, preferably of a dark color, is provided on the inside of the outermost glass pane 26a along the upper marginal end thereof. Since the sides and lower end of the window panel 21 include no outer frame, utilization of such dark silk screening masking along the upper perimeter of the substantially frameless window panel has been found to give the window panel a modernistic substantially all glass appearance.

From the foregoing, it can be seen that the refrigerator display cabinet of the present invention has a thermally insulated window panel that can be repeatedly raised and lowered in a commercial environment about an upper peripheral pivot axis without damage to the glass unit. The clamp and hinge assemblies for the window panel furthermore have a relatively streamlined configuration, which together with the substantially frameless window panel, provides an esthetic modernistic appearance to the cabinet. The window panel and its mounting also are of relatively simple construction which lend themselves to economical manufacture.

We claim:

1. A refrigerator display case comprising a cabinet for containing refrigerated items for display, said cabinet having a front opening, a window panel, clamp and hinge means engageable with an upper marginal end of said window panel for supporting said window panel for pivotal movement relative to said cabinet about a horizontal axis adjacent said upper marginal end between a lowered position closing said cabinet opening and a raised position for permitting access to the interior of said cabinet through said front opening, fluid controlled cylinder means for facilitating and controlling movement of said panel between said lowered and raised positions, said window panel comprising a pair of glass panels disposed in side-by-side relation, a spacer interposed between said panes for maintaining said panes in parallel relation with an air space therebetween, said spacer including a pair of side spacer members disposed between said glass panes adjacent opposite peripheral sides of said window panel and upper and lower spacer members disposed between said glass panes adjacent upper and lower peripheral ends of said window panel respectively, said upper spacer member being in the form of a solid metal bar having a rectangular cross section, said spacer bar extending the entire width of the upper marginal end of said window panel, said solid spacer bar being located between said glass panes at the location engaged by said clamp and hinge means, said clamp and hinge means including a pair of relatively pivotal clamping plates, and means for adjustably pivoting at least one of said clamping plates relative to the other for establishing the desired clamping pressure on said window panel with said upper spacer bar disposed directly between said clamping plates.

2. The refrigerator display case of claim 1 in which side and bottom spacer members are hollow tubular members.

3. The refrigerator display case of claim 1 in which said glass panes are separated by a distance corresponding to the width of said spacer, and said spacer having a length in a direction transverse to the pivot axis of said window panel that is substantially greater than the distance said glass panes are separated.

4. The refrigerator display case of claim 3 in which said spacer bar has a length of about twice the width of said spacer.

5. The refrigerator display case of claim 2 in which said side spacer members are connected to opposite ends of said bottom spacer member by respective corner keys, and said side spacer members having flattened upper ends positively secured to opposite ends of said solid spacer bar by fasteners.

6. The refrigerator display case of claim 1 in which said cabinet includes a horizontal top wall, and said clamp and hinge means supports said window panel forwardly of said top wall.

7. The refrigerator display case of claim 1 in which said clamp and hinge means including a pivot hinge plate mounted on an underside of said top cabinet wall, said hinge plate having a forwardly extending end upon which said clamping plates are supported, and said cylinder means is connected to said hinge plate for facilitating pivotal movement of said window panel between said closed and open positions.

8. The refrigerator display case of claim 7 including selectively adjustable screws disposed in one of said clamping plates for selectively effecting relative pivotal movement between said clamping plates and adjusting the clamping pressure of said clamping plates on said window panel.

9. The refrigerator display case of claim 1 in which said clamp and hinge means includes a pivot hinge plate supported for pivotal movement about a pivot axis intermediate opposite ends thereof, said clamping plates being disposed on a forwardly extending end of said hinge plate, and said cylinder means being coupled to a rearward end of said hinge plate.

10. The refrigerator display case of claim 9 in which said cabinet includes a horizontal top wall, said clamp and hinge means including a mounting bracket having a base mounted on the underside of said top wall, and said bracket supports said hinge plate with said hinge plate pivot axis disposed at an elevation above said base.

11. The refrigerator display case of claim 9 in which said hinge plate has a substantially flat underside extending the length thereof disposed substantially horizontally when said window panel is in said lowered position and at a substantial angle to the horizontal when said window panel is in a raised position for obstructing viewing of said bracket and cylinder means through said cabinet opening from a front side of said cabinet.

12. The refrigerator display case of claim 11 in which said cabinet includes a horizontal to wall, said clamp and hinge means including a U-shaped bracket having a web horizontally mounted on an underside of said top wall and a pair of depending legs on opposite sides of said web, and said hinge plate being disposed at a level between said web and the lower peripheries of said bracket legs when said window panel is in said lowered position.

13. The refrigerator display case of claim 12 in which said bracket has a hinge plate pivot support disposed at an elevation above said web, said hinge plate having a mounting hub extending upwardly from a top side thereof intermediate opposite ends thereof when said window panel is in a lowered position, and said hinge plate hub portion being supported by said bracket hinge plate pivot support for relative pivotal movement.

14. The refrigerator display case of claim 13 in which said cylinder means is connected between said hinge plate and bracket.

15. The refrigerator display case of claim 14 in which said cylinder means has a forward end pivotally connected to said hinge plate and a rearward end pivotally connected to said bracket, and said pivotal connection of the forward end of said cylinder being at an elevation above the pivotal connection at the rearward end of said cylinder when said window panel is in said lowered position.

16. The refrigerator display case of claim 15 in which said pivotal connection at the forward end of said cylinder is at an elevation below the pivotal connection at the rearward end of said cylinder when said window panel is in said raised position.

17. The refrigerator display case of claim 13 in which said cabinet top wall is recessed for receiving said hinge plate hub.

18. The refrigerator display case of claim 17 in which said cabinet top wall comprises inner and outer plates with insulating material therebetween.

19. The refrigerator display case of claim 18 in which said top wall inner plate and insulating material are recessed to receive said hinge plate mounting hub, and said top wall outer plate overlies said hinge plate mounting hub to obstruct viewing thereof from a top side of said cabinet.

20. The refrigerator display case of claim 6 in which one of said clamping plates has a rearward flange extending in overlying relation to said cabinet top wall, sealing means disposed between said clamping plate flange and said top cabinet wall for establishing a seal therebetween when said window panel is in said closed position.

21. The refrigerator display case of claim 20 in which said sealing means includes a sealing member mounted on said top cabinet wall, and said rearward clamping plate flange is movable into engagement with said sealing member upon movement of said window panel from said lowered position to said raised position.

22. The refrigerator display case of claim 21 in which said top wall comprises inner and outer plates with insulating material therebetween, and said sealing member being mounted on a forward end of the outer plate of said cabinet top wall.

23. The refrigerator display case of claim 6 in which said clamping means includes a pair of clamping plates for engaging said upper marginal end of said window panel, and said hinge plate having a forwardly extending end upon which said clamping plates are supported.

24. A refrigerator display case comprising a cabinet for containing refrigerator items for display, said cabinet having a horizontal top wall and a front opening, a window panel, clamp and hinge means engageable with an upper marginal end of said window panel for supporting said window panel for pivotal movement relative to said top cabinet wall about a horizontal axis adjacent said upper marginal end between a lowered position closing said cabinet opening and a raised position for permitting access to the interior of said cabinet through said front opening, said window panel comprising a pair of glass panes disposed in side-by-side relation and a spacer interposed between said panes for maintaining said panes in parallel relation with an air space therebetween, said clamp and hinge means including bracket means mounted on an underside of said cabinet wall and a pivot hinge plate pivotally supported by said bracket means, clamping means on a forwardly extending end of said hinge plate for engaging and supporting said window panel, fluid controlled cylinder means coupled to said hinge plate for facilitating and controlling pivotal movement of said hinge plate and window panel between said lowered and raised positions, said hinge plate having a substantially flat underside extending the length thereof disposed substantially horizontally when said window panel is in said lowered position and at a substantial angle to the horizontal when said window panel is in said raised position for obstructing viewing of said bracket means and cylinder means through said cabinet opening from a front side of said cabinet, said bracket means having a base horizontally mounted on the underside of said top wall and a pair of depending legs on opposite sides of said base, and said hinge plate flat underside being disposed at a level between said base and the lower peripheries of said bracket legs when said window panel is in said lowered position.

25. The refrigerator display case of claim 24 in which said bracket means base has a hinge plate pivot support disposed at an elevation above said base.

26. The refrigerator display case of claim 25 in which said hinge plate has a mounting hub extending upwardly from a top side thereof intermediate opposite ends thereof when said window panel is in a lowered position, and said hinge plate hub being supported by said hinge plate pivot support for relative pivotal movement.

27. The refrigerator display case of claim 26 in which said cabinet top wall is recessed for receiving said hinge plate hub.

28. The refrigerator display case of claim 27 in which said cabinet top wall comprises inner and outer plates with insulating material therebetween, and said top wall inner plate and insulating material are recessed to receive said hinge plate mounting hub, and said top wall outer plate overlies said hinge plate mounting hub to obstruct viewing thereof from a top side of said cabinet.

29. The refrigerator display case of claim 25 in which said cylinder means has a forward end pivotally connected to said hinge plate and a rearward end pivotally connected to said bracket, and said pivotal connection of the forward end of said cylinder being at an elevation above the pivotal connection at the rearward end of said cylinder when said window panel is in said lowered position.

30. The refrigerator display case of claim 29 in which said pivotal connection at the forward end of said cylinder is at an elevation below the pivotal connection at the rearward end of said cylinder when said window panel is in said raised position.

* * * * *